United States Patent [19]

Mansfield

[11] 4,284,477

[45] Aug. 18, 1981

[54] COKING APPARATUS FOR PRODUCING COKE

[75] Inventor: Vaughn Mansfield, Gallatin, Tenn.

[73] Assignee: Mansfield Carbon Products, Inc., Nashville, Tenn.

[21] Appl. No.: 172,294

[22] Filed: Jul. 25, 1980

Related U.S. Application Data

[63] Continuation of Ser. No. 919,299, Jun. 26, 1978, abandoned.

[51] Int. Cl.[3] ..... C10B 1/04; C10B 29/04; C10B 37/04; C10B 39/02

[52] U.S. Cl. ..... 202/110; 202/114; 202/126; 202/150; 202/228; 202/266; 202/268; 202/269

[58] Field of Search ..... 201/5, 15, 26, 27, 35, 201/39, 40; 202/110, 114, 116, 126, 150, 228, 223, 266, 268, 269, 120, 86, 87, 95, 252, 253

[56] References Cited

U.S. PATENT DOCUMENTS

| | | | |
|---|---|---|---|
| 1,874,344 | 8/1932 | Parr et al. | 202/150 |
| 2,041,883 | 5/1936 | Vandegrift et al. | 202/150 |
| 2,131,702 | 9/1938 | Berry | 202/228 |
| 2,240,575 | 5/1941 | Puening | 202/269 |
| 2,413,335 | 12/1946 | Puening | 202/223 |
| 2,580,700 | 1/1952 | Phillips | 202/252 |
| 3,013,951 | 12/1961 | Mansfield | 201/44 |
| 3,073,756 | 1/1963 | Bower | 202/266 |
| 3,300,391 | 1/1967 | Bower | 202/223 |
| 3,331,754 | 7/1967 | Mansfield | 201/32 |
| 3,888,742 | 6/1975 | Kemmetmueller | 202/228 |
| 4,007,093 | 2/1977 | Doilov et al. | 202/269 |
| 4,050,990 | 9/1977 | Lorenz | 202/126 |

*Primary Examiner*—Bradley Garris

[57] ABSTRACT

Vertically elongate pockets are defined between fixed and horizontally movable vertical refractory walls. When the bottom of the pocket is closed, coal dropped into the pocket from above is compressed between the fixed and movable walls and heated to coking temperature by hot gases in vertical flues extending through the refractory walls. When coked, the moveable wall recedes and the coke therein drops into a shaft furnace below, where devolatilization is complete and the coke is quenched in an inert gas atmosphere, which is totally enclosed to prevent air pollution.

2 Claims, 6 Drawing Figures

COKING APPARATUS FOR PRODUCING COKE

This application is a continuation, of application Ser. No. 919,299, filed June 26, 1978 now abandoned.

FIELD OF INVENTION

Distillation apparatus, retort, vertical.

OBJECTS

The object of this invention is to provide a movable wall coking oven wherein coal in a vertically elongate pocket is compressed between opposed vertical refractory walls which are heated by hot gases in flues in the walls. With this process, the type of coal is not critical as to whether it is low, medium, or high volatile, good heat-transfer contact between the heated walls and the coal is maintained, and provision is made by wall pressure to accommodate for the swelling of the coal during coking to prevent damage to the refractory coke oven structure.

A further object is to coke coal without oxidizing its fixed carbon content, while utilizing a small percentage of its volatile content as fuel to provide heat for the process. More particularly, it is intended to provide for ducting the volatile gases driven off from the coal to produce a valuable coke oven gas of about 550 B.t.u. content for by-product recovery or other energy-using purposes while the coal is being heated and coked to completion. The hot spent gases which have been burned to produce the heat for coking are used to pre-dry the incoming coal to remove moisture from the infeed coal. The inert gases used to quench the fully coked coal are used to pre-heat the pre-dried coal to about 400° F. Thus, separate and complete control of the burned and unburned gases can be maintained, with resultant maximum heat conservation and the process is clean and non-polluting.

Still another object is to provide for a multi-pocket coking system wherein the residence time of the coal in each pocket is comparatively short, e.g., about one hour versus 17 to 19 hours for conventional ovens, and wherein the pockets can be separately and serially charged with coal and discharged, and wherein the charging and discharging operation can be automatically and computer controlled. By reducing the time required for coking and by serially charging and discharging the pockets, a large throughput can be maintained, and by utilizing a shaft furnace beneath the pockets for final devolatization of the coke and as a surge chamber, a continuous output of coke can be maintained, notwithstanding the batch-process characteristics of each individual pocket.

With this process, the prime objective is to prevent particulate and gaseous pollution, good heat transfer contact between heated walls and the coal is maintained, and provision is made by wall pressure to accommodate the use of a wide range of swelling coals during coking to prevent damage to the refractory coke oven structure.

A further object is to coke coal without oxidizing its fixed carbon content, while utilizing a small percentage of its volatile content as fuel to provide heat for the process. The movable wall coke oven can coke one type of coal without the need for expensive blending of low, medium and high volatile coals. Blending is essential in conventional coke ovens to prevent the pressure of swelling from damaging refractory walls.

The advantage of using one type coal is made possible by the yieldable movable walls. These and other objects will be apparent from the following specification, claims and drawings, in which:

Figure 1:
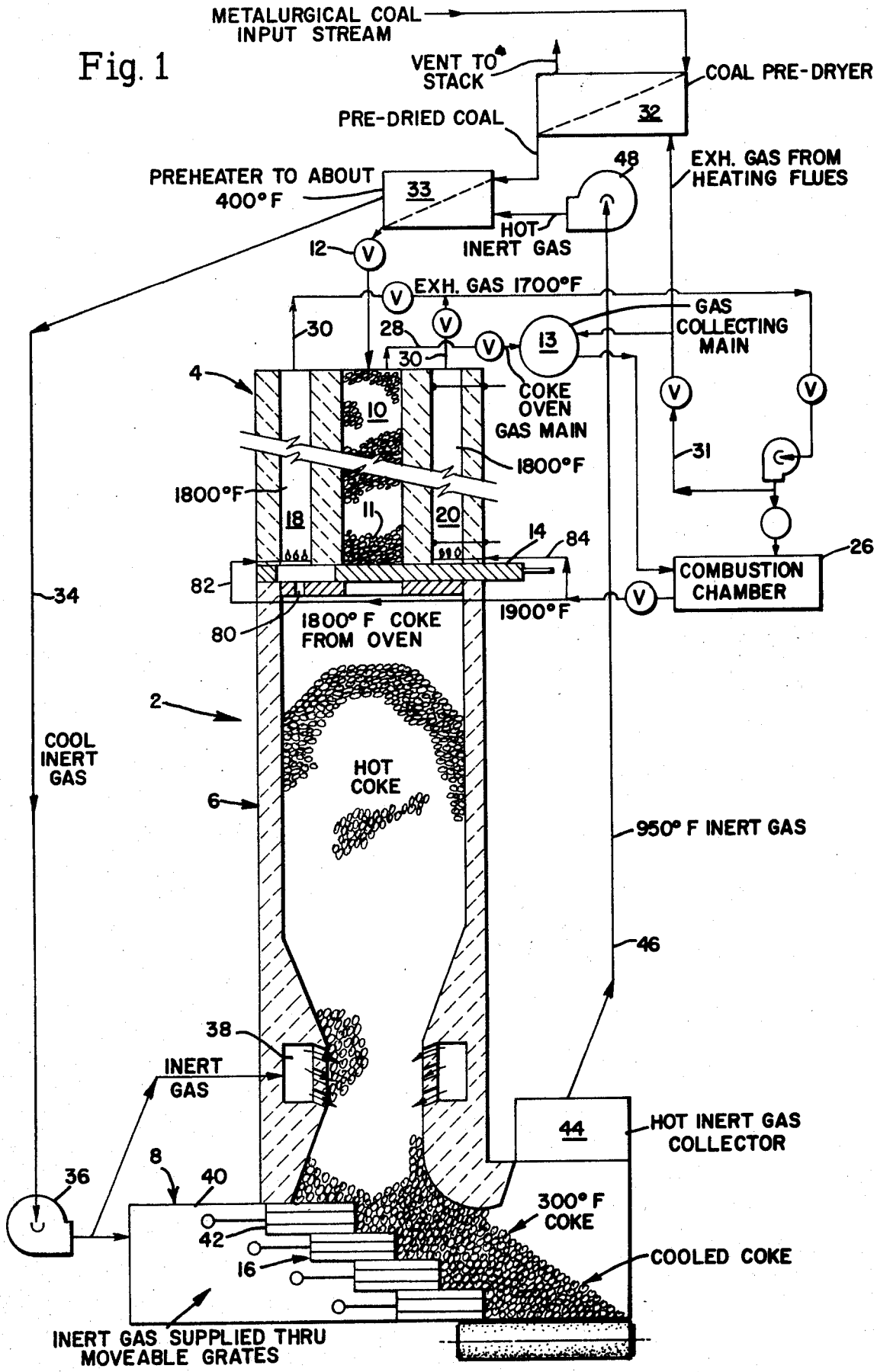
FIG. 1 is a diagrammatic cross-section illustrating the solids and gas flows through the system.

Referring now to the drawings, in which like reference numerals denote similar elements, the apparatus designated 2 is comprised of a movable wall coking oven 4, a shaft furnace 6 therebeneath, and a quencher 8 beneath the shaft furnace. The movable wall coking oven 4 has a plurality of side-by-side vertically elongate pockets 10 each closed by a computer controlled valve 12 at its top and a gate 14 at its bottom. Green coal, after preheating, is fed into a pocket 10 through valve 12, retained there until it is coked and most of the volatiles have been driven off and then, when gate 14 is opened, the then hot coke drops into shaft furnace 6, from the bottom of which it is discharged on reciprocating grate 16 after a predetermined residence time in the shaft furnace.

The ceramic walls of the movable wall coking oven 4 have heating flues 18, 20, 22, and 24 which are heated by hot gases from a combustion chamber 26. Part of the gaseous volatiles which are driven off from the coal 11 in pockets 10 provide the gaseous fuel for the combustion chamber 26. These volatile gases are supplied via valve-controlled gas take-offs 28 to a gas main 13 which also supplies part of the rich coal gases to a by-product utilization device. At the top of flues 18, 20, 22 and 24 are take-offs 30 for the hot spent gases, part of which are returned to combustion chamber 26. Other of the hot spent gases are fed via line 31 to a coal pre-dryer 32 which removes all of the moisture from the incoming green coal. The pre-dried coal is fed from pre-dryer 32 to a coal pre-heater 33 in which the temperature of the coal is raised to about 400° F. The spent gases, having given up heat in the coal pre-heater, are drawn via a line 34 by fan 36, from which part of the inert gas is fed into the coke near the bottom of the shaft furnace 6 via louvers 38. The remainder of the relatively cool inert gas is blown into an enclosure 40 for the coke quencher 8 and passed through vents 42 in reciprocating grates 16 and into the coke emerging from the bottom of coal pre-heater 6 so as to reduce the temperature of the coke to about 300° F. Having collected heat in coke quencher 8, the inert gases, then at about 950° F., are collected in a collector 44 and passed via a line 46 to a fan 48 and thence to the coal pre-heater 33.

Figure 2:
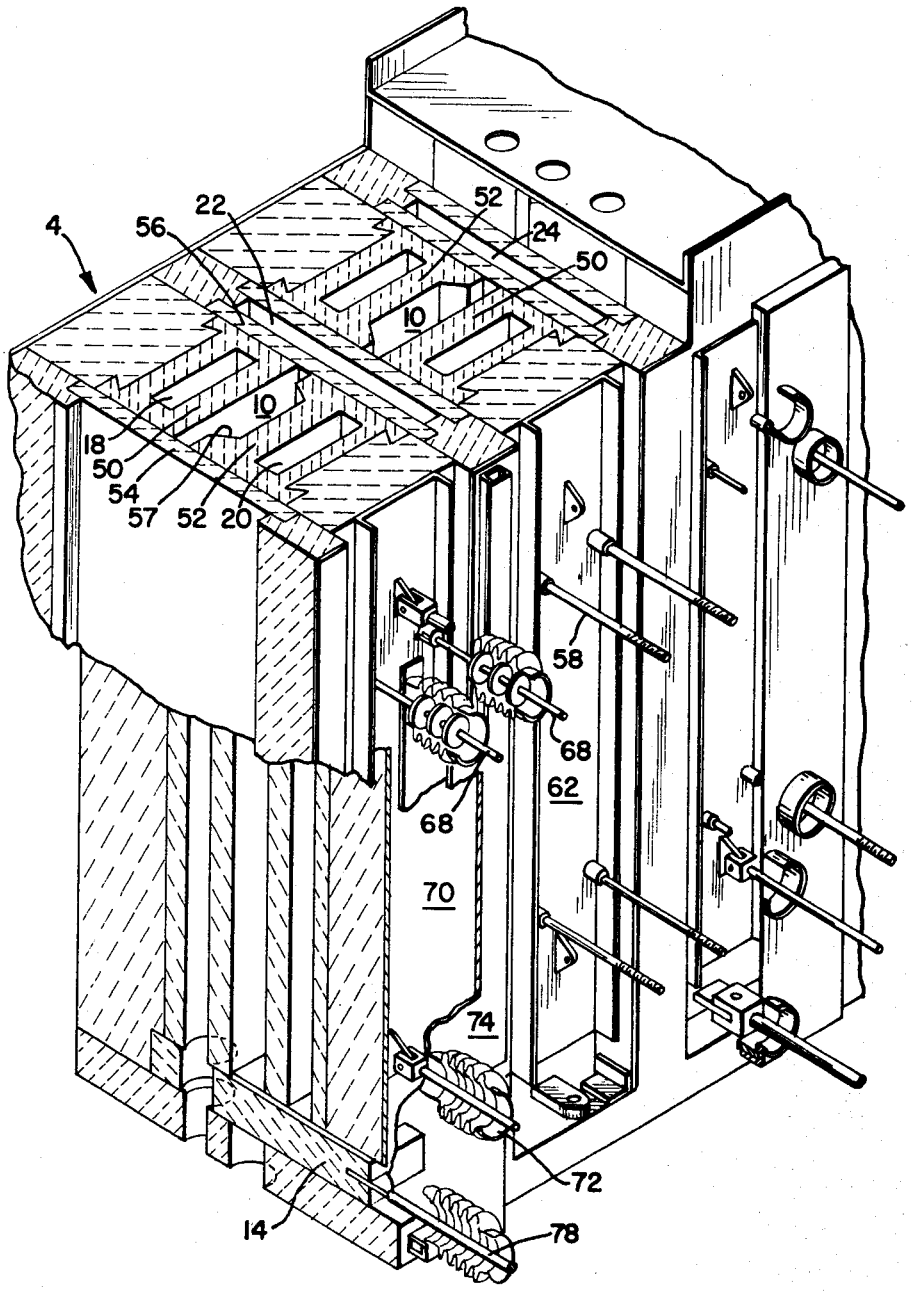
FIG. 2 is a fragmentary isometric view, partly in cross-section, illustrating the pockets, flues, movable walls and gates.
Figure 4:
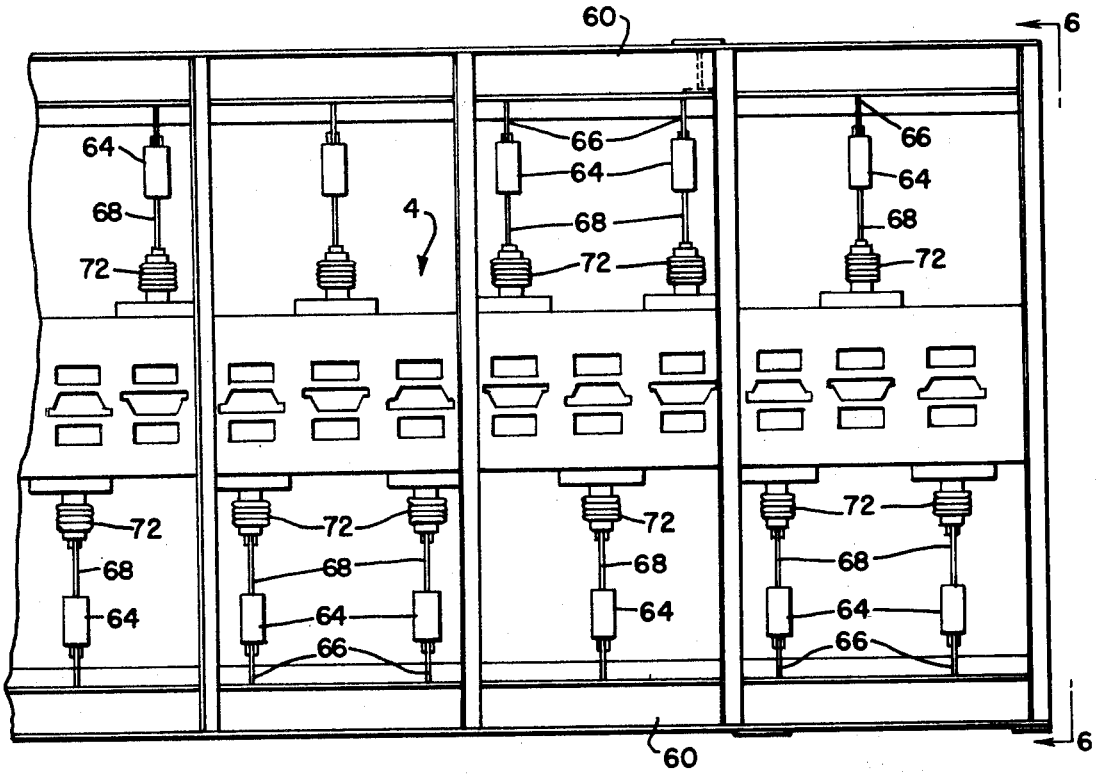
FIG. 4 is a diagrammatic top plan view of a series of three-pocket units illustrating the layout of the movable wall pockets and the actuating rams for the movable walls.
Figure 3:
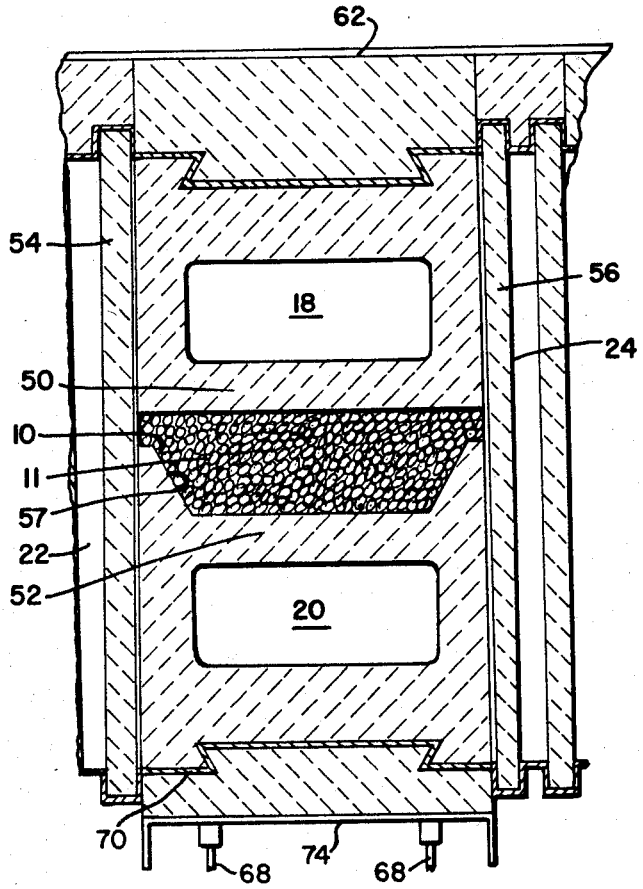
FIG. 3 is a fragmentary horizontal cross-section illustrating a pocket and the adjacent wall structure.
Figure 5:
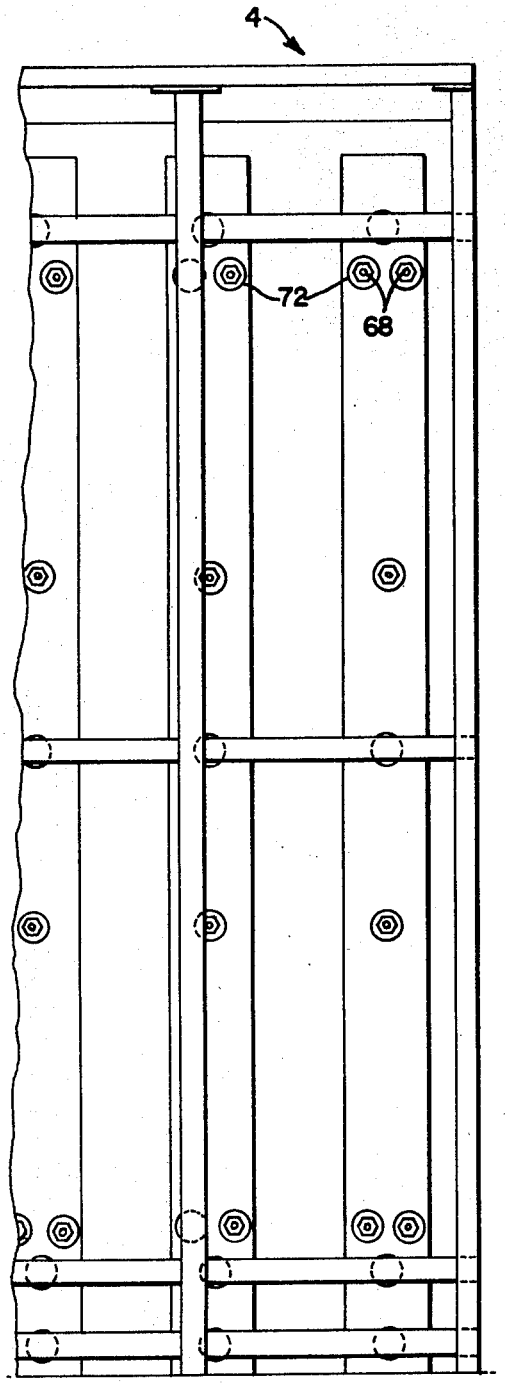
FIG. 5 is a fragmentary and diagrammatic elevation showing the arrangement of actuating rams for movable walls.
Figure 6:
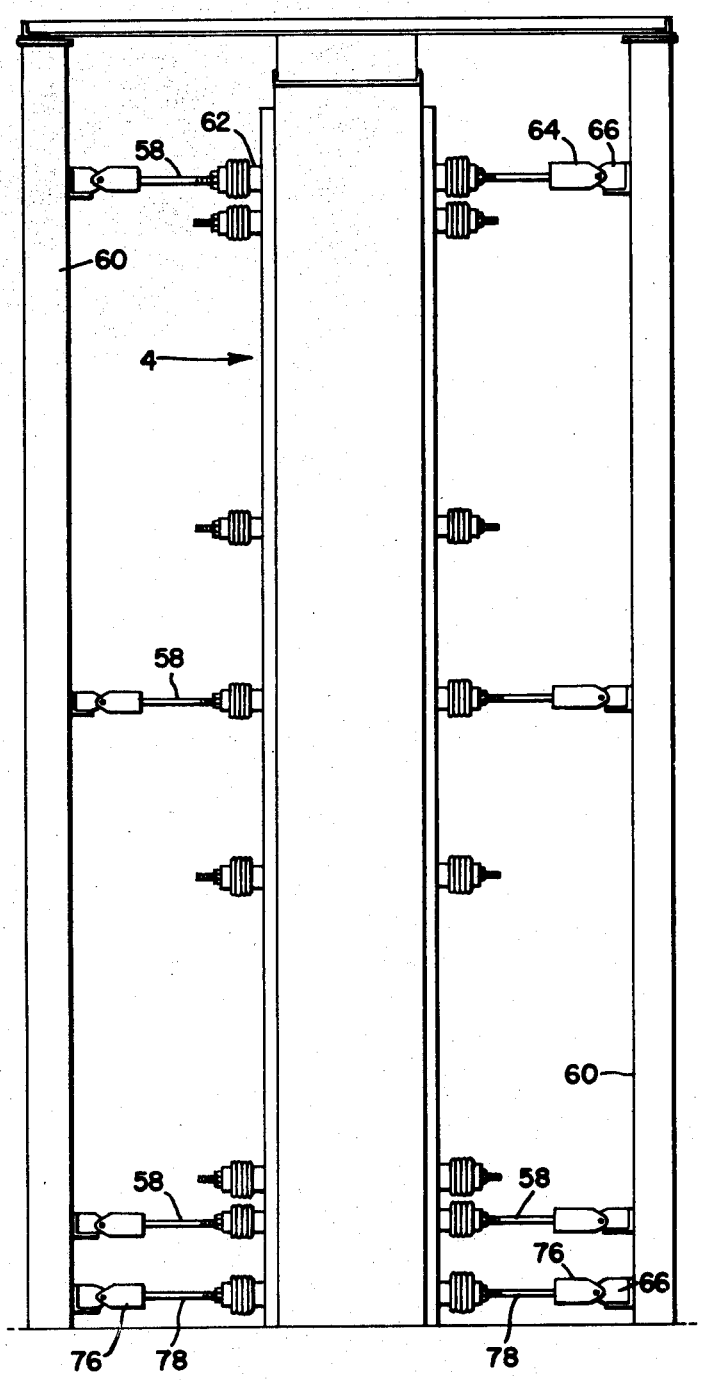
FIG. 6 is a diagrammatic end elevation showing the arrangement of the actuating rams for the movable walls.

Referring more particularly to FIGS. 2–6, the pockets 10 in movable wall coking oven 4 are bounded by a fixed wall 50 opposite which is a movable wall 52, and on each side is a slab 54 or 56. The sides of the pockets defined by the movable walls are tapered as in 57 to facilitate the fall-out of the column of hot coke when the pockets 10 and gates 14 are opened. The fixed walls are braced by rods 58 which extend from a frame 60 to back-up plate 62 on the fixed walls. The movable walls 52 are actuated by hydraulic rams 64 which are connected as at 66 to the frame. Ram rods 68 drive or pull against back-up plates 70 on the outer sides of the movable walls. Suitable seals are provided between the fixed elements of the assembly and the movable walls, and the ram rods 68 extend through seals 72 in cover plates 74, all of these various seals being provided to deter leakage to the atmosphere of the volatile gases driven off the coal in the pockets.

In operation, gates 14 at the bottoms of the pockets are closed by the action of rams 76 whose ram rods 78 are connected to the gates. The movable walls 52 are then drawn away from fixed walls 50. This motion is relatively short, being only about one inch. Valves 12 are then opened to charge the pockets with the preheated coal, it being understood that the tops of the pockets are suitably closed except for the coal charging lines from computer controlled valves and the gas take-off lines 28. Rams 64 are then actuated to close the pockets and compress the coal which has been charged therein. The hot gases from combustion chamber 26, being about 1800° F., heat the coal in the pockets so as to drive off most of the volatile gases and coke the coal. During this process, the coal swells and hydraulic rams 64 are suitably controlled so as to accommodate for the swelling without causing it to fracture the ceramic walls which define the pockets. After about 60 minutes, the coal will have coked, whereupon the gates 14 are opened to drop the columns of hot coke into the shaft furnace 6, as previously described. Residual gases issuing from the hot coke in shaft furnace 6 are exhausted via vents 80 into flues 18 where residual volatiles are burned.

It is contemplated that there will be a series of the units described hereinbefore, and that the pockets will be serially charged and discharged. Because of the residence time in the common shaft furnace, estimated to average about 60 minutes, the coke output of the quencher will be continuous. The gas burning system is designed to prevent build-up of moisture as the process continues.

The gas system for heating the flues is partly closed, and it runs as follows: the hot spent gases from the flues are passed via line 30 into combustion chamber and thence via lines 82 and 84 to the bottoms of the flues. Rich volatile gases from the coal 11 in pockets 10 are passed via take-off lines 28 and main 13 into the combustion chamber 26 as make-up fuel for this otherwise closed system.

I claim:

1. Apparatus for coking coal comprising:

a plurality of adjacent vertically elongate side-by-side pockets each defined between spaced parallel vertically elongate fixed side walls and a vertically elongate fixed end wall rigidly affixed between said side walls and defining therewith a substantially U-shaped fixed wall structure, and a movable vertically elongate end wall spaced oppositely from and parallel to the fixed end wall and extending across the mouth of the U formed by the fixed side and end walls wherein each pocket, save the endmost ones, shares a common fixed side wall with adjacent pockets;

each of said pockets having at a lower end thereof individual gate means for opening and closing the same;

means for charging coal into said pockets via the upper ends thereof;

gas passage means extending vertically through said side and end walls;

means for feeding hot combustion gases through said passages for heating the coal in said pockets to coking temperatures;

individual means respectively associated with each of said movable end walls for moving the same towards and away from the opposite end walls whereby to selectively maintain the coal in said pockets under compression and to release the same from compression; and shaft furnace means disposed beneath and common to said plurality of said pockets for receiving coke discharged through the lower end thereof.

2. Apparatus for coking coal as claimed in claim 1, wherein the mouths of alternate ones of the U's defined between said fixed side and end walls face in one direction and the mouths of U's of intervening ones of said U's face oppositely therefrom.

* * * * *